United States Patent [19]

Robert

[11] 4,158,935

[45] Jun. 26, 1979

[54] SANDING APPARATUS

[75] Inventor: Jean H. P. Robert, Paris, France

[73] Assignee: La Francaise Metallurgie, Paris, France

[21] Appl. No.: 835,699

[22] Filed: Sep. 22, 1977

[30] Foreign Application Priority Data

Sep. 27, 1976 [FR] France ..... 76 28956

[51] Int. Cl.[2] ..... B24B 23/02; B24B 55/06

[52] U.S. Cl. ..... 51/170 T; 51/273

[58] Field of Search ..... 51/170 T, 356, 358, 51/362, 378, 379, 376, 377, 273, 177

[56] References Cited

U.S. PATENT DOCUMENTS

| | | | |
|---|---|---|---|
| 1,353,966 | 9/1920 | Lorenz | 51/379 |
| 1,765,808 | 6/1930 | Tone | 51/356 |
| 2,527,762 | 10/1950 | Pratt | 51/356 |
| 3,638,362 | 2/1972 | Stoll | 51/273 |
| 3,754,359 | 8/1973 | Scandaletos | 51/356 |
| 3,932,966 | 1/1976 | Stern | 51/356 |

FOREIGN PATENT DOCUMENTS 2212773 7/1974 France

*Primary Examiner*—Nicholas P. Godici

[57] ABSTRACT

A sanding apparatus comprising a grooved circular backing plate adapted to be detachably secured to one end of a rotatably driven hollow shaft and supporting an abrasive-coated paper disc formed with a plurality of through holes communicating with grooves formed in the front face of the backing plate, a hollow cylindrical member forming an extension of the hollow shaft and protruding in a recessed central portion of the front face of the backing plate through a central hole thereof, a free space being provided between the central portions of the backing plate and abrasive-coated paper disc, respectively, around the hollow cylindrical member in which radial orifices are formed for allowing said free space to communicate with the interior of said member and of the hollow shaft coupled to suction means.

3 Claims, 2 Drawing Figures

28
27
26
6
8
3
7
5
2
4
1
18
10
9
16
19
19
15
25
14
24
11
17
12
12
G
G
20
21
23
22

12
14
20
F
11
13

SANDING APPARATUS

BACKGROUND OF THE INVENTION

FIELD OF THE INVENTION

The present invention relates to a sanding apparatus of the type comprising a circular backing plate adapted to be secured to one end of a rotatably driven shaft, said backing plate having an outer front face having formed therein a plurality of grooves extending from a peripheral portion to a recessed central portion of the front face of the backing plate, and acting as a support for an abrasive-coated paper disc.

In known sanding apparatus of this type, holes communicating with the grooves of the backing plate may be formed in the abrasive-coated paper disc. The holes formed in the abrasive-coated paper disc and the grooves formed in the front face of the rotating backing plate are intended for ventilating and therefore cooling these elements. Moreover, the grooves formed in the front face of the rotating backing plate are usually curved in a direction opposite the direction of rotation of the backing plate from the central portion to the peripheral portion of the backing plate. In fact, this specific curved configuration of the grooves is directed to improve the ventilation by forcing the air towards the outer periphery of the backing plate.

It is known that sanding apparatus utilizing abrasive-coated paper discs mounted on a rotating circular backing plate generate, like all sanders, a considerable amount of fine particles of dust which are particularly noxious for the operator. In sanding apparatus of the above-mentioned type, comprising a rotating backing plate and an abrasive-coated paper disc, both ventilated, this inconvenience is emphasized by the fact that the ventilation air increases the dispersion of fine dust particles much more than in sanders with non-ventilated rotating backing plate and abrasive-coated paper disc.

On the other hand, sanders, notably of the type used in building construction, which comprise a front-acting grinding wheel secured to the end of a hollow shaft and formed with grooves in its active front surface, are already known in the art. In these known sanders, the grooves communicate with a cavity formed centrally of the active front surface of the grinding wheel, said cavity communicating with the hollow shaft connected to suction means capable of drawing up from the center of grinding the wheel the fine dust particles generated by the grinding wheel (see French Pat. No. 2,212,773). Sanders of this last type, utilizing a front-action grinding wheel, not an abrasive-coated paper disc as in the case of the sanding apparatus contemplated herein, are capable of absorbing the dust completely, thus avoiding the noxious dispersion of fine particles by the grinding wheel.

SUMMARY OF THE INVENTION

It is therefore the essential object of the present invention to provide a sanding apparatus of the type set forth hereinabove, i.e. comprising a rotating backing plate and an abrasive-coated paper disc, which is capable not only to properly ventilate the abrasive-coated paper disc but also to efficiently suck up the fine dust particles generated thereby in actual service.

To this end, the invention provides a sanding apparatus of the type broadly set forth above, wherein said shaft is hollow, the sanding apparatus further comprising a hollow cylindrical member having a closed front end and forming an extension of said hollow shaft protruding in the recessed central portion of the front face of the backing plate, means for detachably securing said abrasive-coated paper disc at the center thereof to said closed front end of said hollow cylindrical member, a free space being formed between the central portions of said backing plate and of said abrasive-coated paper disc, respectively, around said hollow cylindrical member, said free space communicating with said grooves of said backing plate, said hollow cylindrical member having formed in the peripheral surface thereof a plurality of orifices providing communicating paths between said free space and an axial bore of said hollow cylindrical member and of said hollow shaft, and suction means coupled to another end of said hollow shaft remote from said one end thereof.

According to a preferred embodiment of the invention, the abrasive coated paper disc may have formed therein a plurality of holes, which, in use, communicate with the grooves of said backing plate. Also, the grooves formed in the front face of the backing plate may have a curved configuration. However, in contrast to the grooves of backing plates of previously known sanding apparatus, the grooves formed in the backing plate of the sanding aparatus of the present invention are curved in the direction of rotation of said backing plate. With this specific orientation of the groove curvature, the dust particles sucked through the holes of the abrasive-coated paper disc are caused to move towards the center of the backing plate into the free space formed between the central portions of the backing plate and of the abrasive-coated paper disc and, hence, into said hollow cylindrical members through the orifices thereof. Moreover, also as a consequence of the specific curvature imparted to the grooves and therefore, to the ribs separating adjacent grooves from each other on the front face of said backing plate, said ribs act somewhat like the blades of a suction fan of which the specific action is combined with that of said suction means for sucking the fine dust particles which, as a consequence of the centrifugal force, are thus caused to escape outwardly beyond the outer peripheral edge of the abrasive-coated paper disc. Therefore, the dust sucking efficiency of the sanding apparatus is further improved.

Now a detailed description of a preferred embodiment of the present invention will be given with reference to the attached drawing, in which:

DESCRIPTION OF THE PREFERRED EMBODIMENT

Figure 1:
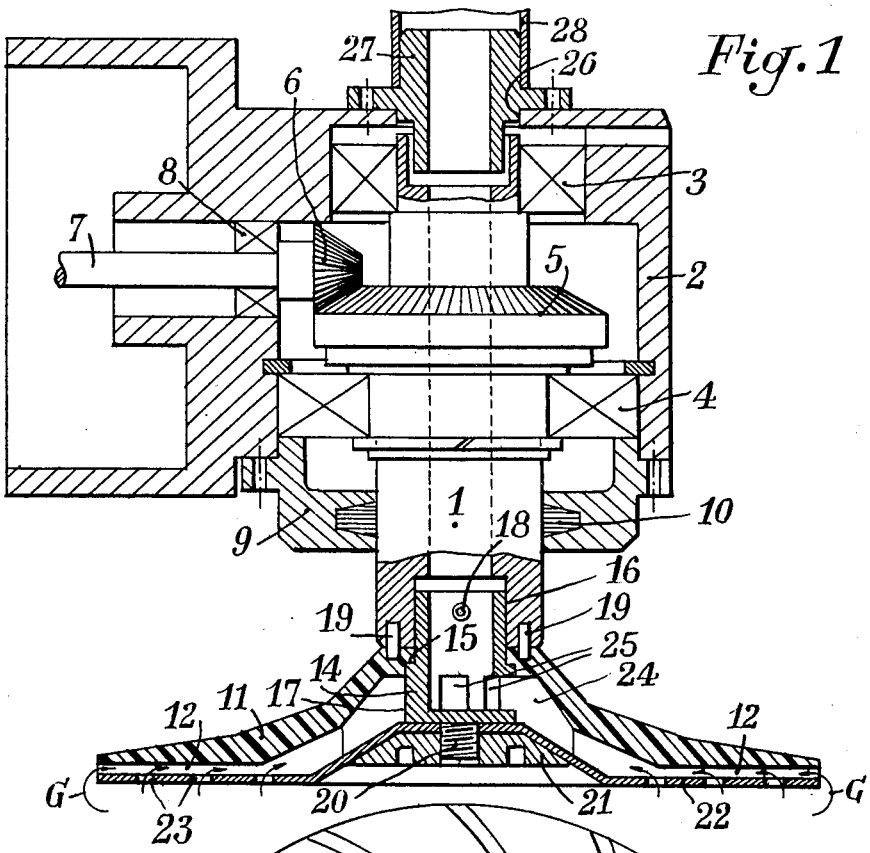
FIG. 1 is a fragmentary axial section showing the essential component elements of the sanding apparatus of the invention.

The sanding apparatus shown in FIG. 1 comprises a hollow shaft 1 rotatably mounted in a casing 2 by means of a pair of ball-bearings 3 and 4.

The shaft 1 may be rotatably driven from an electric motor (not shown) or from other power means such as compressed air in the case of a pneumatic motor, through a pair of bevel gears 5, 6 keyed on the shaft 1 and on another shaft 7, respectively. The shaft 7 extends at right angles to shaft 1 and is mounted for rotation in said casing 2 by means of a ball-bearing 8. The shaft 7 may, if desired, be the output shaft of a driving motor and, in this case, the motor proper is housed in a suitable portion (not shown) of casing 2. According to a modified construction, said shaft 7 may be an intermediate shaft adapted to be coupled in a known manner to the output shaft of a power unit to which various attachments or accessories such as sanding unit, a drill chuck, a circular saw, or the like can be fitted. In this last alternative, the casing 2 may be so arranged in a known manner that it can be detachably adapted and secured to the casing of the power unit or motor.

Figure 2:
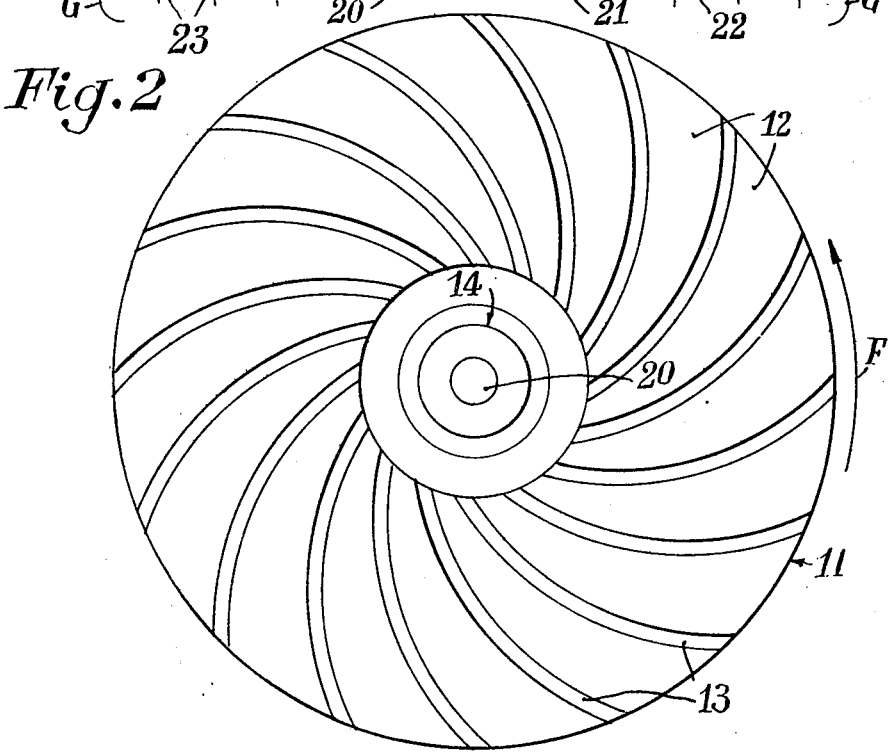
FIG. 2 is a front view of the outer front surface of the rotating backing plate from which the abrasive-coated paper disc has been removed.

At its lower portion, the casing 2 is closed by a cover 9 formed with a central aperture through which the hollow shaft 1 extends. An annular seal 10 is provided in said aperture, said seal being for example made of oil-impregnated felt. Secured to the lower end of hollow shaft 1 is a circular backing plate 11 made for example of a suitable plastic material. The backing plate 11 has a plurality of curved grooves 12 formed in its lower or front face. As shown in FIG. 2, said grooves 12 and the ribs 13 between the grooves 12 are preferably curved in the direction of rotation (see arrow F) of plate 11 from a recessed central portion to the peripheral portion of the front face of the backing plate 11.

In the embodiment illustrated in FIG. 1, the backing plate 11 has a central through hole, and is secured to the lower end of hollow shaft 1 by means of a hollow cylindrical member 14. More particularly, the hollow cylindrical member 14 comprises an outer peripheral shoulder 15 separating an upper cylindrical portion 16 of relatively small outer diameter, adapted to fit into a corresponding axial bore of the hollow shaft 1, from a lower cylindrical portion 17 of relatively larger outer diameter. For securing the backing plate 11 to the hollow shaft 1, an edge portion of the central hole of backing plate 11 is clamped between said shoulder 15 and the front or lowermost end portion of hollow shaft 1, and the upper portion 16 of said hollow cylindrical member 14 is secured inside the hollow shaft 1 for example by means of three radial clamping screws 18 (of which only one is shown in FIG. 1). (As an alternative, and as a substitute for the set of three screws 18, the upper portion 16 of member 14 may be threaded externally and the bore of hollow shaft 1 may comprise a corresponding tapped lower portion for screw engagement by the threaded upper portion 16). A pair of axial fins 19 forced fitted into the lower end of hollow shaft 1 are adapted to engage corresponding blind holes formed in the upper or rear face of backing plate 11 in order to transmit the drive of shaft 1 to said plate 11.

The lower portion 17 of member 14 is closed at its bottom or front end and carries thereat a short depending screw-threaded stud 20 adapted to be engaged by a nut 21 for securing an abrasive-coated paper disc 22 in bearing engagement with the closed end of portion 17 of member 14 and also with the outer surface of the ribs 13 formed on backing plate 11. Preferably, the abrasive-coated paper disc 22 has a plurality of holes 23 formed therethrough, which communicate with the grooves 12 of backing plate 11. If desired, the abrasive-coated paper disc 22 may be of the type known under the Trade Name "FIBERSPAM".

As shown in FIG. 1, the closed front or lower end of portion 17 of member 14 is somewhat spaced in the axial direction from the central portion of backing plate 11 which is recessed in order to provide a free space or cavity 24 between the abrasive-coated paper disc 22 and the backing plate 11 around member 14. A plurality of orifices 25 are formed in the outer periphery of the lower portion 17 of cylindrical member 14 to provide a communication path between said free space 24 and the grooves 12, on the one hand, and the axial bore of member 14 and of hollow shaft 1, on the other hand.

At its upper portion, the casing 2 comprises an aperture 26 coaxial to hollow shaft 1, in which a flanged sleeve 27 is fitted. The flanged sleeve 27 extends partly inside and partly outside with respect to the casing 2. The inner portion of sleeve 27 extends somewhat into the upper portion of hollow shaft 1, and its outer portion is coupled to one end of a flexible hose 28 having its opposite end coupled to a vacuum cleaner or like suction means or apparatus (not shown).

With this arrangement, in operation, when the backing plate 11 and abrasive-coated paper disc 22 are rotated, the fine dust produced by the abrasive action of disc 22 is sucked up through the holes 23 of disc 22 and directed through the grooves 12, the free space 24, the orifices 25, the axial bore of member 14 and hollow shaft 1, the sleeve 27 and the flexible hose 28 to the dust container of the vacuum cleaner or other similar apparatus incorporating conventional filter means. The fine dust particles which, as a consequence of the centrifugal action, may escape outwardly beyond the peripheral edge of disc 22 are also sucked into the grooves 12 as shown by the arrows G in FIG. 1.

Although, for properly carrying out the present invention in actual practice, it is preferred to use a perforated abrasive-coated paper disc it would not constitute a departure from the present invention to use an imperforated disc for, as just explained in the foregoing, fine dust particles are also sucked in at the outer periphery of abrasive-coated paper disc 22.

Of course, the embodiment of the present invention which has been described hereinabove and illustrated in the accompanying drawing should not be construed as limiting the scope of the invention since many modifications and variations may be brought thereto without departing from the basic principles of the invention as set forth in the appended claims. Thus, notably, the hollow cylindrical member 14 may be formed integrally with the hollow shaft 1. Alternatively, the hollow cylindrical member 14 may be an integral part of the backing plate 11. In this last instance, the hollow cylindrical member 14 may be for example in the form of a metal insert embedded by molding in the material constituting the backing plate 11.

What I claim as new is:

1. A sanding apparatus having a sanding head and means for suctional cleaning effect, said head comprising, a rotatable tubular shaft with a bore, a circular backing plate provided with a recessed central portion, a hollow cylindrical member constituting an extension of said tubular shaft and protruding in the recessed central portion of said backing plate, said cylindrical member having a closed front face, and an abrasive-coated paper disc detachably affixed to said closed front face for covering the front face of said backing plate, a space being thus provided between said backing plate and said disc, said cylindrical member having openings for providing communication between said space and the bore of said tubular shaft which is connected to said suctional cleaning means, the front face of said backing plate having ribs curved in the direction of rotation of said backing plate, said ribs forming grooves therebetween which are an integral part of said space and engaging said disc at the ridges thereof, said ribs thus cooperating with said suctional cleaning means in removal of dust particles generated over the entire periphery and circular edge of said backing plate, the outer ends of said ribs extending to the circular edge of said backing plate, each curved rib extending progressively away from its inner end with respect to the radius of the circle which bounds said backing plate and passes through said inner end.

2. A sanding apparatus as claimed in claim 1, wherein said abrasive disc has formed therein a plurality of holes, which, in use, communicate with the grooves of said backing plate.

3. A sanding apparatus comprising a circular backing plate adapted to be detachably secured to one end of a rotatable driven shaft, said backing plate having an outer front face having formed therein a plurality of grooves extending from a peripheral portion to a recessed central portion of the front face of the backing plate, and acting as a support for an abrasive-coated paper disc, wherein said shaft is hollow, the sanding apparatus further comprising a hollow cylindrical member having a closed front end and forming an extension of said hollow shaft protruding in the recessed central portion of the front face of the backing plate, said circular backing plate having a central hole formed therethrough, said hollow cylindrical member having formed thereon an annular shoulder separating an upper cylindrical portion of said member of relatively small diameter from a lower cylindrical portion of said member of greater diameter than said upper portion, said upper portion of said member being engaged into an end portion of the axial bore of said hollow shaft and being detachably secured therein, said lower cylindrical portion of said member having said closed front end and having formed in its peripheral surface a plurality of orifices, said backing plate being secured to said hollow shaft by clamping an edge portion of said central hole of said backing plate between said shoulder of said member and said one end of said hollow shaft, means for detachably securing said abrasive-coated paper disc at the center thereof to said closed front end of said hollow cylindrical member, a free space being formed between the central portions of said backing plate and of said abrasive-coated paper disc, respectively, around said hollow cylindrical member, said free space communicating with said grooves of said backing plate, said plurality of orifices providing communicating paths between said free space and an axial bore of said hollow cylindrical member and of said hollow shaft, and suction means coupled to another end of said hollow shaft remote from said one end thereof.

* * * * *